US007332071B2

(12) United States Patent
Benazzi et al.

(10) Patent No.: US 7,332,071 B2
(45) Date of Patent: Feb. 19, 2008

(54) PROCESS FOR IMPROVING AROMATIC AND NAPHTHENO-AROMATIC GAS OIL FRACTIONS

(75) Inventors: Eric Benazzi, Chatou (FR); Patrick Bourges, Rueil Malmaison (FR); Christophe Gueret, St Romain en Gal (FR); Pierre Marion, Antony (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 493 days.

(21) Appl. No.: 10/367,963

(22) Filed: Feb. 19, 2003

(65) Prior Publication Data

US 2004/0020825 A1 Feb. 5, 2004

(30) Foreign Application Priority Data

Feb. 15, 2002 (FR) ..... 02 01970

(51) Int. Cl.
*C10G 45/00* (2006.01)
*C10G 65/02* (2006.01)

(52) U.S. Cl. ..... 208/89; 208/15; 208/57; 208/58; 208/59; 208/109; 208/110; 208/111.1; 208/111.2; 208/111.3; 208/143; 208/210; 208/251 H; 208/254 H

(58) Field of Classification Search ..... 208/111.1, 208/143, 109, 110, 111.2, 111.3, 15, 57, 58, 208/59, 89, 210, 251 H, 254 H
See application file for complete search history.

(56) References Cited

U.S. PATENT DOCUMENTS 3,637,484 A * 1/1972 Hansford ..... 208/143
3,703,461 A * 11/1972 Hansford et al. ..... 208/143
5,118,406 A 6/1992 Kokayeff et al.
6,387,246 B1 * 5/2002 Benazzi et al. ..... 208/111.01

FOREIGN PATENT DOCUMENTS

| | | |
|---|---|---|
| EP | 0277718 | 8/1988 |
| EP | 0848992 | 6/1998 |
| WO | 0611816 A1 * | 8/1994 |

* cited by examiner

*Primary Examiner*—Glenn Caldarola
*Assistant Examiner*—Prem C. Singh
(74) *Attorney, Agent, or Firm*—Millen, White, Zelano, Branigan, P.C.

(57) ABSTRACT

Process for transforming a gas oil fraction that makes it possible to produce a fuel that has a quality according to stringent requirements in terms of sulfur content, aromatic compound content, cetane number, boiling point, T95, of 95% of the compounds and density, d15/4, at 15° C. This process comprises a hydrorefining stage and a subsequent stage, whereby the latter uses a catalyst that is selected from the group that consists of hydrorefining catalysts and catalysts that comprise at least one mixed oxide, a metal of group VIB, and a non-noble metal of group VIII. The conversion of products that have a boiling point of less than 150° C. is, for the hydrorefining stage, between 1 and 15% by weight. The temperature, TR2, of the subsequent stage is less than the temperature, TR1, of the hydrorefining stage, and the variation between temperatures TR1 and TR2 is between 0 and 80° C.

15 Claims, No Drawings

PROCESS FOR IMPROVING AROMATIC AND NAPHTHENO-AROMATIC GAS OIL FRACTIONS

This invention relates to the field of fuels for internal combustion engines. It relates more particularly to the conversion of a gas oil fraction and in particular the production of a fuel for a compression-ignition engine. It also relates to the thus obtained fuel.

Currently, the gas oil fractions, whether they are obtained from direct distillation of a crude oil or whether they are obtained from a conversion process such as catalytic cracking, also contain non-negligible amounts of aromatic compounds, and nitrogen- and sulfur-containing compounds.

Within the legislative framework of most of the industrialized countries, there are requirements that relate to the maximum content of these products in fuels. Other requirements are also applied to fuels, such as the cetane number that should be above a certain threshold, the density, d15/4, at 15° C., and the boiling point, T95, (ASTM D86 method) of 95% of the components, whereby these last two should be below a certain limit.

Currently in Europe, a fuel should have a cetane number that is higher than 51, a sulfur content that is less than 350 ppm (parts per million by mass), a density, d15/4, at 15° C. less than 0.845 g/cm$^3$, a content of polyaromatic compounds that is less than 11% by weight and a boiling point, T95, of 95% of its components that is less than 360° C.

These requirements, however, will be the object of revisions aimed at making them still more restricting. For example, in Europe, provisions are being made for 2005 to reduce the maximum sulfur content requirement to 50 ppm, and even 10 ppm in some countries. These restricting revisions, however, will not be limited only to the sulfur content. It is also being considered to increase the threshold of the cetane number to 58, and even to a higher value in some countries, as well as to reduce the maximum density d15/4 to 0.825 g/cm$^3$, the maximum content of polyaromatic compounds to 1% by weight and the maximum temperature T95 to 340° C.

It is therefore necessary to develop reliable, effective and economically viable processes that make it possible to produce fuels that have improved characteristics as regards the cetane number, the content of polyaromatic, sulfur and nitrogen compounds, as well as the density, d15/4, at 15° C., and the boiling point, T95, of 95% of the components of the fuel.

Processes such as high-pressure hydrocracking make it possible to produce, from heavy feedstocks such as vacuum distillates, gas oil fractions that have a good quality and that meet current requirements. The investment for such a unit, however, is generally high. Furthermore, this type of process is often inadequate and inappropriate for gas oil fractions of average, and even mediocre, quality.

The gas oil fractions are generally obtained either from direct distillation of crude or from catalytic cracking: i.e., light distillate fractions (English initials LCO for Light Cycle Oil), heavy fractions (English initials HCO for Heavy Cycle Oil), or from another conversion process (coking, visbreaking, residue hydroconversion, etc.) or else gas oils that are obtained from aromatic or naphtheno-aromatic crude petroleum distillation of Cerro-Negro, Zuata, or El Pao type. It is particularly important to produce an effluent that can be directly and integrally upgraded as a fuel fraction of very high quality.

The standard processes, such as high-pressure hydrocracking, make it possible to increase the cetane number, to reduce the sulfur content and to satisfy the current requirements for certain feedstocks that already initially have advantageous qualities. However, in the case of gas oil fractions that are obtained from a catalytic cracking-type conversion process such as the LCO or else gas oil fractions that are obtained from the distillation of crude oils, i.e., gas oil fractions that have high contents of aromatic or naphtheno-aromatic compounds, the improvement in the quality of this gas oil fraction in terms of cetane number, sulfur content, density, d15/4, at 15° C., boiling point, T95, of 95% of the components and contents of polyaromatic compounds, reaches limits that cannot be exceeded by concatenations of standard processes.

The prior art reveals processes for hydrogenation of petroleum fractions that are particularly high in aromatic compounds that use a catalyst, for example U.S. Pat. No. 5,037,532 or the publication "Proceeding of the 14$^{th}$ World Petroleum Congress, 1994, pp. 19-26." These documents note processes leading to obtaining hydrocarbon-containing fractions for which an increase in the cetane number is obtained by an intense hydrogenation of aromatic compounds.

Patent FR 2 777 290 proposes a process that combines hydrocracking with hydrogenation for the purpose of reducing the sulfur content and increasing the cetane number of the fuels that are thus produced. This process, which already has good performance levels, should, however, be the subject of improvements to make it possible to meet increasingly strict requirements that will be imposed in most of the industrialized countries.

An improved process combining hydrocracking with hydrogenation that makes it possible to produce fuels that meet increasingly stringent requirements, not only with a maximum sulfur content of 350 ppm, preferably 50 ppm, and a minimum cetane number of 51, preferably 53, in particular 58, but also a maximum temperature T95 of 360° C., preferably 340° C., a maximum content of polyaromatic compounds of 11% by weight, preferably 6% by weight, in particular 1% by weight, and a maximum density d15/4 of 0.845 g/cm$^3$, preferably 0.825 g/cm$^3$, was found. The fuels obtained by this improved process thus have a high cetane number and a reduced sulfur content that meets current and future requirements. In addition, they have a boiling point T95, a density d15/4, and polyaromatic compound contents that are adequately reduced to make it possible to meet not only the current requirements and preferably expectations of future European requirements of 2005.

An object of this invention is also to provide a process that can be carried out under simple and economically viable conditions, and in particular that does not involve high pressures and that leads to good gas oil yields.

The main object of this invention is therefore to provide a process for conversion of a gas oil fraction, in particular a gas oil fraction with a high content of aromatic or naphtheno-aromatic compounds, making it possible to improve its cetane number and to reduce its contents of sulfur, and aromatic and polyaromatic compounds while reducing its temperature T95 (ASTM D86) and its density d15/4, so as to meet the most stringent future requirements that will be applied to the gas oil fractions.

The invention therefore relates to a process for transforming a gas oil fraction that comprises:

a) at least one hydrorefining stage during which the gas oil fraction is brought into contact with a catalyst, in the presence of hydrogen and at a temperature TR1, whereby said catalyst comprises:
   an amorphous mineral substrate, at least one metal of group VIB of the periodic table,
at least one non-noble metal of group VIII of said classification, and
at least one promoter element that is selected from the group that consists of phosphorus, boron, silicon and fluorine, and b) at least one subsequent hydrocracking stage during which at least a portion of the products that are obtained from the hydrorefining stage are brought into contact in the presence of hydrogen and at a temperature TR2 with a catalyst that is selected from the group that consists of the catalysts that comprise:
an amorphous mineral substrate,
at least one metal of group VIB of the periodic table,
at least one non-noble metal of group VIII of said classification, and,
at least one promoter element that is selected from the group that consists of phosphorus, boron, silicon and fluorine, and the catalysts that comprise:
at least one mixed oxide that is selected from the group that consists of amorphous silica-aluminas, silica-alumina-titanium and silica-alumina-zirconia,
at least one metal of group VIB of the periodic table,
at least one non-noble metal of group VIII of said classification, and
optionally a mineral binder, in which the conversion of products that have a boiling point that is less than 150° C. is, for the hydrorefining stage, between 1 and 15% by weight, and in that the temperature, TR2, of the subsequent stage is less than the temperature, TR1, of the hydrorefining stage and in that the variation between temperatures TR1 and TR2 is between 0. and 80° C.

The operating conditions of the process of the invention have led, surprisingly enough, to fuels that not only have a reduced sulfur content and a higher cetane number, but also a boiling point, T95, of 95% of the components, an aromatic compound content and a density, d15/4, at 15° C. that have lower values.

The gas oil feedstocks that are to be treated are generally light gas oils, such as, for example, direct distillation gas oils, fluid catalytic cracking gas oils (English initials FCC for Fluid Catalytic Cracking) or (LCO). They generally have an initial boiling point of at least 180° C. and a final boiling point of at most 370° C. The composition by weight of these feedstocks by hydrocarbon family is variable according to the intervals. According to the compositions that are usually encountered, the paraffin contents are between 5.0 and 30.0% by weight, and the contents of naphthenes are between 5.0 and 60% by weight. The gas oil feedstocks preferably have an aromatic compound content (including polyaromatic compounds and naphtheno-aromatic compounds) of between 20% and 90%, in particular between 40% and 80% by weight.

The process according to the invention makes it possible, during the first hydrorefining stage, to reduce the sulfur content, the nitrogen content, and the content of aromatic and polyaromatic compounds, as well as to increase the cetane number.

According to an aspect of the invention, the conversion of products that have a boiling point that is less than 150° C. is limited to the hydrorefining stage. Thus, the conversion of products that have a boiling point that is less than 150° C. is, for the hydrorefining stage, between 1 and 15%, preferably 5 and 15% by weight. The operating conditions that are to be applied to ensure these conversion levels promote the reduction of the content of aromatic compounds by hydrogenating them and increasing the cetane number.

According to another aspect of the invention, the subsequent stage of the process is carried out at a lower temperature than that of the hydrorefining stage. It was noted with surprise that this made it possible to complete the hydrogenation of the aromatic and polyaromatic compounds while making it possible, nevertheless, to carry out a moderate cracking of the feedstock, since said cracking is carried out at relatively low temperatures. Thus, the variation between temperature TR1 of the hydrorefining stage and temperature TR2 of the subsequent stage is between 0 and 80° C. This variation is preferably between 5° C. and 70° C., especially between 10° C. and 60° C., in particular between 15° C. and 50° C. Alternately, this variation can be between 11° C. and 70° C., preferably between 13° C. and 60° C., in particular between 15° C. and 50° C.

The process of the invention thus makes it possible to increase, during the subsequent stage, the cetane number while reducing the density, d15/4, and the temperature, T95, of the gas oil fraction. The fuel that is produced thus meets the most stringent future requirements.

According to a preferred method of this invention, the conversion of products that have a boiling point that is less than 150° C. is, throughout the two stages of the process, kept below a certain limit, beyond which it was found that the cetane number ran the risk of being reduced because of the presence of aromatic compounds. Thus, the conversion of products that have a boiling point that is less than 150° C. is, throughout the two stages of the process, less than 35%, preferably less than 30%, and in particular less than 25% by weight.

According to the invention, the catalyst that is used during the hydrorefining stage of the process of this invention, also called hydrorefining catalyst, comprises on an amorphous mineral substrate at least one metal of group VIB of the periodic table, at least one non-noble metal of group VIII of this same classification and at least one promoter element. The metals of groups VIB and VIII constitute the hydro-dehydrogenating element of the hydrorefining catalyst.

Advantageously, during the hydrorefining stage, the feedstock is brought into contact with a hydrorefining catalyst that comprises at least one substrate, at least one element of group VIB of the periodic table, at least one element of group VIII of this same classification, at least one promoter element, whereby the latter is deposited on said catalyst, optionally at least one element of group VIIB such as manganese, and optionally at least one element of group VB such as niobium.

According to the invention, the promoter element is selected from the group that consists of phosphorus, boron, silicon and fluorine.

The hydrorefining catalyst preferably comprises boron and/or silicon, as well as optionally, and preferably, phosphorus as promoter elements. The contents of boron, silicon, and phosphorus are then generally, for each of these elements, between 0.1 and 20% by weight, preferably between 0.1 and 15% by weight, in particular between 0.1 and 10% by weight. The presence of phosphorus provides at least two advantages to the hydrorefining catalyst. The phosphorus facilitates the impregnation of the nickel and molybdenum solutions, and it also improves the hydrogenation activity.

The amorphous mineral substrates of the hydrorefining catalyst can be used by themselves or in a mixture. These substrates of the hydrorefining catalyst can be selected from among alumina, halogenated alumina, silica, silica-alumina, clays, magnesia, titanium oxide, boron oxide, zirconia, aluminum phosphates, titanium phosphates, zirconium phosphates, carbon and aluminates. Among the clays, it is possible to select natural clays, such as kaolin or bentonite. The substrates that are used preferably contain alumina, under all these forms that are known to one skilled in the art, and even more preferably are aluminas, for example gamma-alumina.

The hydro-dehydrogenating function of the hydrorefining catalyst is generally performed by at least one metal of group VIB of the periodic table and at least one non-noble metal of group VIII of this same classification, whereby these metals are preferably selected from among molybdenum, tungsten, nickel and cobalt. In particular, this function can be ensured by the combination of at least one element of group VIII (Ni, Co) with at least one element of group VIB (Mo, W).

According to a preferred method of the invention, the hydrorefining catalyst that comprises phosphorus is such that the total concentration in metal oxides of groups VIB and VIII is between 5 and 40% by weight, preferably between 7 and 30% by weight. The ratio by weight that is expressed in terms of metal oxide between group VIB metal (or metals) vs. group VIII metal (or metals) is preferably between 20 and 1.25, even more preferably between 10 and 2. Furthermore, the concentration of phosphorus oxide $P_2O_5$ in this catalyst is preferably less than 15% by weight, in particular less than 10% by weight.

According to another preferred method of the invention, the hydrorefining catalyst comprises boron and/or silicon, preferably boron and silicon. Advantageously, the hydrorefining catalyst comprises a percentage by weight relative to the total mass of the catalyst:

- 3 to 60%, preferably 3 to 45%, even more preferably 3 to 30% of at least one metal of group VIB,
- 0.5 to 30%, preferably 0.5 to 25%, even more preferably 0.5 to 20% of at least one metal of group VIII,
- 0.1 to 99%, preferably 10 to 98%, for example 15 to 95% of at least one amorphous mineral substrate,
- 0.1 to 20%, preferably 0.1 to 15%, even more preferably 0.1 to 10% of boron and/or 0.1 to 20%, preferably 0.1 to 15%, even more preferably 0.1 to 10% of silicon,
- optionally 0 to 20%, preferably 0.1 to 15%, even more preferably 0.1 to 10% of phosphorus, and
- optionally 0 to 20%, preferably 0.1 to 15%, even more preferably 0.1 to 10% of at least one element that is selected from group VIIA, preferably fluorine.

In a general way, the formulations that have the following atomic ratios are preferred:

- an atomic ratio: group VIII metal/group VIB metal of between 0 and 1,
- an atomic ratio: B/group VIB metals of between 0.01 and 3,
- an atomic ratio: Si/group VIB metals of between 0.01 and 1.5,
- an atomic ratio: P/group VIB metals of between 0.01 and 1,
- an atomic ratio: group VIIA metal/group VIB metals of between 0.01 and 2.

Such a hydrorefining catalyst has an activity of hydrogenation of aromatic hydrocarbons, hydrodenitrating and hydrodesulfurization that is more significant than the catalytic formulas without boron and/or silicon. This type of catalyst also has a more significant activity and selectivity of hydrocracking than the catalytic formulas known in the prior art. A catalyst that comprises boron and silicon is particularly active, which induces, on the one hand, an improvement in hydrogenating, hydrodesulfurizing and hydrodenitrating properties, and, on the other hand, an improvement in the activity of hydrocracking relative to the catalysts that are usually used in the hydrorefining and hydroconversion reactions.

According to another preferred method of the invention, the preferred hydrorefining catalysts are the catalysts NiMo and/or NiW on alumina, also the catalysts NiMo and/or NiW on alumina that is doped with at least one element included in the group of atoms that consists of phosphorus, boron, silicon and fluorine. Other preferred catalysts are the catalysts NiMo and/or NiW on silica-alumina or on silica-alumina-titanium oxide that may or may not be doped, by at least one element that is included in the group of atoms that consists of phosphorus, boron, fluorine and silicon.

This type of hydrorefining catalyst preferably comprises:

- 5 to 40% by weight of at least one non-noble element of groups VIB and VIII (% oxide),
- 0.1 to 20% by weight of at least one promoter element that is selected from among phosphorus, boron, and silicon (% oxide),
- 0 to 20% by weight of at least one element of group VIIB (manganese, for example),
- 0 to 20% by weight of at least one element of group VIIA (fluorine, chlorine, for example),
- 0 to 60% by weight of at least one element of group VB (niobium, for example), and
- 0.1 to 95% by weight of at least one matrix, and preferably alumina.

The hydrorefining stage is advantageously carried out at a pressure of 5 to 15 MPa, preferably 6 to 13 MPa, even more preferably 7 to 11 MPa, and at a temperature of 310° C. to 420° C., preferably 320 to 400° C., even more preferably 340 to 400° C. The recycling of pure hydrogen per volume of feedstock can be advantageously between 200 and 2500 $Nm^3/m^3$ of feedstock, preferably between 300 and 2000 $Nm^3/m^3$. The volumetric flow rate can be between 0.1 and 5, preferably between 0.1 and 3, expressed by volume of liquid feedstock per volume of catalyst and per hour.

The targeted content of organic nitrogen is generally less than 50 ppm by mass, preferably less than 20 ppm, in particular less than 10 ppm by mass.

Preferably, all of the products that are obtained from the hydrorefining stage are engaged in the subsequent stage of the process of the invention. The hydrorefining stage and the subsequent stage generally take place in at least two separate reaction zones. These reaction zones can be contained in one or more reactors.

The catalyst that is used during the subsequent stage of the process of the invention is a catalyst that is selected from the group that consists of the catalysts that comprise:

- an amorphous mineral substrate,
- at least one metal of group VIB of the periodic table,
- at least one non-noble metal of group VIII of said classification, and
- at least one promoter element that is selected from the group that consists of phosphorus, boron, silicon and fluorine, and catalysts that comprise:

- at least one mixed oxide that is selected from the group that consists of amorphous silica-aluminas, silica-alumina-titanium and silica-alumina-zirconia,
- at least one metal of group VIB of the periodic table,
- at least one non-noble metal of group VIII of said classification, and
- optionally a mineral binder.

In the first case, the characteristics of the catalyst of the subsequent stage can correspond to those of catalysts that can be used during the hydrorefining stage, whereby said characteristics have been presented above.

The catalyst of the subsequent stage of the process of the invention thus preferably comprises:

at least one mixed oxide that is selected from the group that consists of amorphous silica-aluminas, silica-alumina-titanium and silica-alumina-zirconia, at least one metal of group VIB of the periodic table, at least one non-noble metal of group VIII of said classification, and optionally a mineral binder.

In the second case, the catalyst of the subsequent stage of the process of the invention can have the characteristics that are described below.

In this other case, the catalyst of the subsequent stage of the process of the invention comprises:

at least one mixed oxide that is selected from the group that consists of amorphous silica-aluminas, silica-alumina-titanium and silica-alumina-zirconia, at least one metal of group VIB of the periodic table, at least one non-noble metal of group VIII of said classification, and optionally a mineral binder.

The hydro-dehydrogenating function of the catalyst is generally ensured by at least one element of group VIB (for example molybdenum and/or tungsten) and at least one non-noble element of group VIII (for example cobalt and/or nickel) of the periodic table.

A preferred catalyst of the subsequent stage essentially comprises at least one mixed oxide that is selected from the group that consists of amorphous silica-aluminas, silica-alumina-titanium, silica-alumina-zirconia, as well as nickel and molybdenum.

The catalyst of the subsequent stage of the process of the invention preferably also comprises at least one promoter element that is selected from among boron, phosphorus and silicon. Even more preferably, the catalyst can also comprise at least one element of group VIIA (chlorine or fluorine, for example), at least one element of group VIIB (manganese, for example), and at least one element of group VB (niobium, for example).

According to a preferred method of the invention, the catalyst of the subsequent stage of the process comprises, as a promoter element, boron and/or silicon, as well as phosphorus. The concentrations that are introduced for each of these elements are generally between 0.1 and 20% by weight relative to the weight of the catalyst (calculated in terms of oxide).

The elements that are introduced, in particular silicon, can be mainly located on the matrix of the substrate, and this also applies to the catalyst of the refining stage. These elements can be characterized by techniques such as a Castaing microprobe that provides a distribution profile of these various elements, a transmission electron microscopy, combined with an X analysis of the components of the catalyst, or else also by establishing distribution mapping of the elements that are present in the catalyst by electronic microprobe.

When the catalyst is different from the one that is used during the hydrorefining stage, this catalyst can also comprise a mineral binder. The preferred binders are silica and alumina, and even more preferably alumina in all of the forms that are known to one skilled in the art, for example gamma-alununa.

The content by weight of the binder in the substrate of the catalyst can be between 0 and 40%, preferably between 1 and 40%, in particular between 5% and 20%. The result is that the content by weight of mixed oxide varies from 60 to 100%.

A catalyst whose substrate consists only of mixed oxides preferably does not comprise any binder.

The substrate can be prepared by shaping the mixed oxide that is selected from the group that consists of silica-alumina, silica-alununa-zirconia and silica-alumina-titanium, with or without the presence of binder, by any technique that is known to one skilled in the art. The shaping can be carried out by, for example, extrusion, pelletizing, the drop (oil-drop) coagulation method, turntable granulation. or by any other method that is well known to one skilled in the art. At least one calcination stage can be carried out after any of the stages of the preparation. This calcination is usually carried out under air at a temperature of at least 150° C., preferably at least 300° C.

According to a preferred method of this invention, the catalyst of the subsequent stage of the process of the invention comprises a substrate that consists of a mixed oxide, optionally a binder as well as, in addition, expressed in % by weight relative to the total mass of the catalyst:

1 to 60%, preferably 2 to 60%, in particular 2 to 50%, for example 2 to 40% of at least one hydro-dehydrogenating metal that is preferably selected from among the elements of group VIII and group VIB, and 0 to 20%, preferably 0.1 to 15%, in particular 0.1 to 10% of at least one promoter element that is selected from the group that consists of silicon, boron and phosphorus, preferably boron and/or silicon (not including the silicon that is obtained from the silica-alumina of the substrate), 0 to 20%, preferably 0.1 to 15%, in particular 0.1 to 10% of at least one element that is selected from group VIIA, preferably fluorine, 0 to 20%, preferably 0.1 to 15%, in particular 0.1 to 10% of at least one element that is selected from group VIIB, preferably manganese or rhenium, 0 to 20%, preferably 0.1 to 15%, in particular 0.1 to 10% of at least one element that is selected from group VB, preferably niobium.

The metals of group VIB and group VIII of the catalyst of this invention can be present completely or partially in metal form and/or oxide form and/or sulfide form.

The catalysts of the two stages of the process according to the invention can be prepared according to all of the methods that are well known to one skilled in the art.

The subsequent stage is advantageously carried out at a pressure of 5 to 15 MPa, preferably 6 to 13 MPa, even more preferably 7 to 11 MPa ,and at a temperature of 310 to 420° C., preferably 320° C. to 400° C., and even more preferably 340 to 390° C. The recycling of pure hydrogen can be between 200 and 2500 $Nm^3/m^3$, preferably between 300 and 2000 $Nm^3/m^3$.

Prior to the hydrorefining stage and/or the subsequent stage of the process of this invention, each of the catalysts can be subjected to a sulfurization treatment that makes it possible to transform, at least in part, the metal sulfide radicals before they are brought into contact with the feedstock that is to be treated. This treatment of activation by sulfurization is well known to one skilled in the art and can be carried out by any method that is already described in the literature or in situ, i.e., in the reactor, or ex situ.

A standard sulfurization method that is well known to one skilled in the art consists in heating in the presence of hydrogen sulfide (pure or, for example, under a stream of a hydrogen/hydrogen sulfide mixture) at a temperature of between 150 and 800° C., preferably between 250 and 600° C., generally in a flushed-bed reaction zone.

The outlet effluent of the second reaction zone that corresponds to the subsequent stage of the process according to the invention can be subjected to a so-called final separation (for example an atmospheric distillation) so as to separate the gases (such as ammonia $NH_3$ and hydrogen sulfide ($H_2S$), as well as the other light gases that are present, hydrogen, and conversion products (gasoline fraction).

The following examples illustrate the invention without limiting its scope.

EXAMPLE 1

The treated feedstock in this example is a naphthenoaromatic gas oil that is obtained from distillation and whose characteristics are as follows:

TABLE 1

| Physico-Chemical Characteristics of the Feedstock | |
|---|---|
| d15/4 | 0.9045 |
| S content (% by weight) | 2.2 |
| Engine cetane | 34 |
| Content of aromatic compounds (including the polyaromatic compounds) | 47.2 |
| Content of polyaromatic compounds | 20.4 |
| T95 (° C.) | 351 |

This feedstock is introduced into a catalytic test unit that comprises 2 reactors. Used in the upstream reactor is a hydrorefining catalyst that comprises alumina, 3.6% by weight of nickel (oxide), 17.2% by weight of molybdenum (oxide), and 4% by weight of phosphorus (oxide).

This same catalyst is used in the downstream reactor that corresponds to the second stage of the process of the invention.

The operating conditions that are used are as follows:

Total pressure=90 bar $H_2$/HC=1000 liters of hydrogen/liter of feedstock

Overall VVH=0.45$h^{-1}$

TR1=380° C.

TR2=360° C.

The outlet effluent of the unit undergoes distillation so as to recover the 150° C.$^+$ fraction that is then analyzed, and whose characteristics are combined in Table 2 below.

TABLE 2

| Characteristics of the 150° C.$^+$ Fraction After Treatment | |
|---|---|
| d15/4 | 0.844 |
| S content, ppm by weight | 6 |
| Engine cetane | 52 |
| Content of aromatic compounds (% by weight) | 10.8 |
| Content of polyaromatic compounds (% by weight) | 1.3 |
| T95% (ASTM D86) (° C.) | 332 |

The yield of the gas oil fraction of 150° C.$^+$ is 93.5% by weight. The table above shows that all of the characteristics of the 150° C.$^+$ gas oil fraction obtained by the process according to the invention are improved and make it possible to meet the most stringent future requirements.

The preceding examples can be repeated with similar success by substituting the generically or specifically described reactants and/or operating conditions of this invention for those used in the preceding examples.

The entire disclosure of all applications, patents and publications, cited herein and of corresponding French application No. 02/01.970, filed Feb. 15, 2002 is incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for transforming a gas oil fraction that comprises:

a) at least one hydrorefining stage during which the gas oil fraction is brought into contact with a catalyst, in the presence of hydrogen and at a temperature TR1, whereby said catalyst consists of:
   - an amorphous mineral substrate,
   - at least one metal of group VIB of the periodic table,
   - at least one non-noble metal of group VIII, and
   - at least one promoter element that is phosphorus, boron, silicon or fluorine, and b) at least one subsequent stage during which at least a portion of the products that are obtained from the hydrorefining stage are brought into contact in the presence of hydrogen and at a temperature TR2 with a catalyst that comprises:
   - an amorphous mineral substrate,
   - at least one metal of group VIB of the periodic table,
   - at least one non-noble metal of group VIII, and,
   - at least one promoter element that is phosphorus, boron, silicon or fluorine, or:
   - at least one mixed oxide that is amorphous silica-aluminas, silica-alumina-titanium or silica-alumina-zirconia,
   - at least one metal of group VIB of the periodic table,
   - at least one non-noble metal of group VIII, and
   - optionally a mineral binder, wherein the conversion of products that have a boiling point that is less than 150° C. is, for the hydrorefining stage, between 1 and 15% by weight, and the temperature, TR2, of the subsequent stage is less than the temperature, TR1, of the hydrorefining stage, and the variation between temperatures TR1 and TR2 is between 0 and 80° C.

2. A process according to claim 1, wherein the catalyst of the subsequent stage is different from the hydrorefining catalyst of stage a).

3. A process according to claim 1, wherein the gas oil fraction that constitutes the feedstock comprises between 20% and 90% by weight of aromatic compounds.

4. A process according to claim 1, wherein the conversion of products that have a boiling point that is less than 150° C. is, for the hydrorefining stage, between 5 and 15% by weight.

5. A process according to claim 1, wherein the variation between temperature TR1 of the hydrorefining stage and temperature TR2 of the subsequent stage is between 5° C. and 70° C.

6. A process according to claim 1, wherein the variation between temperature $TR_1$ and temperature $TR_2$ of the subsequent stage is between 10° C. and 60° C.

7. A process according to claim 1, wherein the variation between temperature $TR_1$ and temperature $TR_2$ of the subsequent stage is between 15° C. and 50° C.

8. A process according to claim 1, wherein the conversion of products that have a boiling point that is less than 150° C. is, throughout the two stages of the process, less than 30%.

9. A process according to claim 1, wherein the hydrorefining catalyst comprises, as promoter elements, boron and/or silicon, as well as phosphorus, and wherein the contents of boron, silicon, and phosphorus are, for each of these elements, between 0.1 and 20% by weight.

10. A process according to claim 1, wherein a hydrodehydrogenating function of the hydrorefining catalyst is performed by at least one metal of group VIB of the periodic table that is selected from the group that consists of molybdenum and tungsten, and at least one non-noble metal of group VIII that is nickel or cobalt.

11. A process according to claim 1, wherein the hydrorefining catalyst comprises phosphorus and is such that:

the total concentration of metal oxides of groups VIB and VIII is between 5 and 40% by weight, the ratio by weight that is expressed in terms of metal oxide between group VIB metal (or metals) vs. is between 20 and 1.25, the concentration of phosphorus oxide P2O5 is less than 15% by weight.

12. A process according to claim 1, wherein the catalyst of the subsequent stage of the process comprises:

an amorphous mineral substrate, at least one metal of group VIB of the periodic table, at least one non-noble metal of group VIII, and, at least one promoter element that is phosphorus, boron, silicon or fluorine.

13. A process according to claim 1, wherein the substrate of the catalyst of the subsequent stage of the process is prepared by shaping a mixed oxide that is silica-alumina, silica-alumina-zirconia, or silica-alumina-titanium, with or without the presence of binder.

14. A process according to claim 1, wherein the catalyst of the subsequent stage of the process comprises:

at least one mixed oxide that is an amorphous silica-alumina, silica-alumina-titanium or silica-alumina-zirconia, at least one metal of group VIB of the periodic table, at least one non-noble metal of group VIII of said classification, and optionally a mineral binder.

15. A process for transforming a gas oil fraction that consists of:

a) at least one hydrorefining stage during which the gas oil fraction is brought into contact with a catalyst, in the presence of hydrogen and at a temperature TRI, whereby said catalyst consists of:

an amorphous mineral substrate, at least one metal of group VIB of the periodic table, at least one non-noble metal of group VIII, and at least one promoter element that is phosphorus, boron, silicon or fluorine, and b) at least one subsequent stage during which at least a portion of the products that are obtained from the hydrorefining stage are brought into contact in the presence of hydrogen and at a temperature TR2 with a catalyst that consists of:

an amorphous mineral substrate, at least one metal of group VIB of the periodic table, at least one non-noble metal of group VIII, and, at least one promoter element that is phosphorus, boron, silicon or fluorine, or:

at least one mixed oxide that is amorphous silica-aluminas, silica-alumina-titanium or silica-alumina-zirconia, at least one metal of group VIB of the periodic table, at least one non-noble metal of group VIII, and optionally a mineral binder, wherein the conversion of products that have a boiling point that is less than 150° C. is, for the hydrorefining stage, between 1 and 15% by weight, and the temperature, TR2, of the subsequent stage is less than the temperature, TR1, of the hydrorefining stage, and the variation between temperatures TR1 and TR2 is between 0 and 80° C.

* * * * *

UNITED STATES PATENT AND TRADEMARK OFFICE

CERTIFICATE OF CORRECTION

PATENT NO. : 7,332,071 B2
APPLICATION NO. : 10/367963
DATED : February 19, 2008
INVENTOR(S) : Eric Benazzi It is certified that error appears in the above-identified patent and that said Letters Patent is hereby corrected as shown below:

Column 10, line 13, reads "comprises" should read --consists of--

Column 10, line 63, reads "temperature $TR_1$ and temperature $TR_2$" should read --temperature TR1 and temperature TR2--

Column 10, line 66, reads "temperature $TR_1$ and temperature $TR_2$" should read --temperature TR1 and temperature TR2--

Column 11, line 20, reads "vs. is" should read --vs. group VIII metal (or metals) is--

Signed and Sealed this

Twenty-fourth Day of February, 2009

JOHN DOLL
*Acting Director of the United States Patent and Trademark Office*